United States Patent [19]

Favrel

[11] 4,188,889

[45] Feb. 19, 1980

[54] RETRACTABLE RUNNING-BOARD, ESPECIALLY FOR A RAILWAY CAR DOOR

[75] Inventor: Michel Favrel, Le Perreux sur Marne, France

[73] Assignee: Faiveley S.A., Saint Ouen, France

[21] Appl. No.: 903,950

[22] Filed: May 8, 1978

[30] Foreign Application Priority Data

Oct. 13, 1977 [FR] France ..... 77 30871

[51] Int. Cl.[2] ..... B60R 3/02

[52] U.S. Cl. ..... 105/445; 280/166

[58] Field of Search ..... 105/443, 444, 445, 446, 105/447, 449, 450; 280/166

[56] References Cited

U.S. PATENT DOCUMENTS

| | | | |
|---|---|---|---|
| 3,724,396 | 4/1973 | Roth | 105/443 |
| 3,757,284 | 5/1976 | Wright | 105/445 |
| 3,795,205 | 3/1974 | Gritchen et al. | 105/443 |
| 3,981,515 | 9/1976 | Rosborough | 105/443 |
| 4,020,920 | 5/1977 | Abbott | 105/445 |

FOREIGN PATENT DOCUMENTS

| | | | |
|---|---|---|---|
| 1220276 | 6/1966 | Fed. Rep. of Germany | 105/445 |
| 910419 | 5/1974 | Fed. Rep. of Germany | 105/445 |
| 1038241 | 8/1966 | United Kingdom | 105/445 |
| 936846 | 9/1973 | United Kingdom | 105/445 |

*Primary Examiner*—Richard A. Bertsch

*Attorney, Agent, or Firm*—Young & Thompson

[57] ABSTRACT

A movable step displaceable by means of an operating mechanism between a withdrawn position and a service position has an extension in the form of two transverse arms associated with two pairs of link-arms which are pivotally mounted on four shafts having horizontal and parallel axes. Two shafts are stationarily fixed on the floor of the railway car, the second shaft being set back from the first with respect to the car wall. The other two shafts are movable and attached respectively to the transverse arms near the point of connection of these arms to the step, and to the transverse arms at the ends which are pivotally attached to the rear link-arms. Stable immobilization of the step is achieved in the service position as a result of abutting application of the articulations of the transverse arms and of the rear link-arms against a stop.

10 Claims, 5 Drawing Figures

RETRACTABLE RUNNING-BOARD, ESPECIALLY FOR A RAILWAY CAR DOOR

Figure 1:
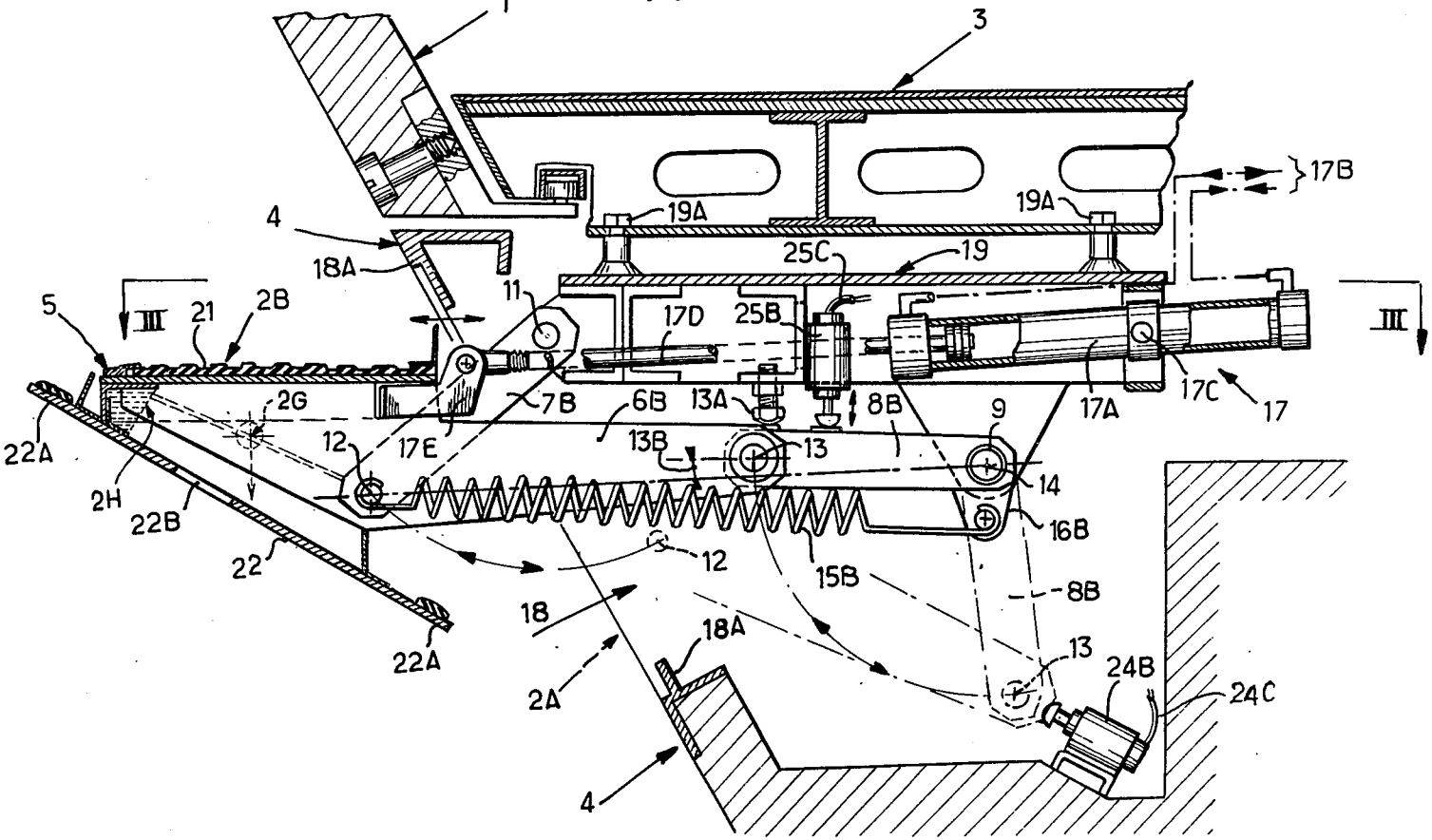

This invention relates to a retractable running-board, especially for the door of a railway car or coach.

Among the many known designs which already exist, a running-board of the type just mentioned comprises a substantially rectangular movable step associated with an operating mechanism which is rigidly fixed to the car. This mechanism serves to displace the step between a withdrawn position and a service position. In the withdrawn position, the step can be applied, for example, in a parallel position against one wall of the car slightly below the level of the car floor. In the service position, the step is swung downwards to the horizontal and has an outwardly projecting front edge in order to provide easier access at the level of the car floor.

This known type of running-board which comprises, for example, a step hinged on the wall by means of an edge opposite to its front edge is consequently subject to a number of disadvantages. In order to ensure a sufficient depth of the step of the order of 25 cm, for example, it is normally necessary to place the hinge at a point which is too low with respect to the level of the door sill to prevent interference of the step in the withdrawn position in the bottom zone of the door. If it is sought to limit the upward projection of the step to an acceptable height of the order of 18 cm, for example, an undesirable reduction in width of the step accordingly becomes necessary.

Moreover, in order to offer a sufficient degree of strength in the service position, the step has a fairly substantial thickness. It thus forms an objectionable and unattractive projection in the withdrawn position if it is considered sufficient to mount the step on the car wall without modifying this latter. In order to circumvent this disadvantage, provision can be made on the wall for a profiled junction edge which is also cumbersome and unattractive. Alternatively, it is possible to form a recess which allows an open gap to remain in the service position of the step.

In another known design of running-board, the movable step is subjected to a substantially horizontal sliding movement or alternatively to a combined movement of vertical sliding and tilting. However, these systems also have the disadvantage of insufficient width of the step or excessive mechanical complexity.

The difficulties recalled in the foregoing are particularly marked in the case of running-boards adapted to fast railway cars which have inclined walls in the bottom zone of the doors and to which the invention is primarily directed.

The aim of the invention is to overcome the difficulties and drawbacks mentioned above by permitting the construction of a retractable running-board which is of relatively simple design, which is convenient to instal and which provides a step of sufficient width in the service position, said step being placed at a suitable level with respect to the floor of the railway car.

The present invention is directed to a retractable running-board especially for the door of a railway car or coach and comprising a substantially rectangular movable step associated with an operating mechanism which is rigidly fixed to the car; said mechanism permits displacement of the step between a withdrawn position and a service position; in the withdrawn position, the step is applied against and parallel to one wall of the car; in the service position, the step is swung outwards horizontally and has an outwardly projecting front edge in order to ensure ease of access at the level of the car floor.

In accordance with the invention, the running-board aforesaid is distinguished by the fact that the movable step is rigidly extended on the side opposite to its front edge by means of two transverse arms of equal length which are substantially horizontal in the service position of the step. The operating mechanism comprises two pairs of link-arms, the ends of which are pivotally mounted on four horizontal axes parallel to the front edge of the step. The two ends of each link-arm of the first pair of so-called front pair are mounted respectively on a first axis disposed in fixed relation to the railway car and on a second axis disposed in fixed relation to the step in the vicinity of the point of junction of each of the two transverse arms. The two ends of each link-arm of the second pair or so-called rear pair are mounted respectively on a third axis located in a fixed position at those ends of the transverse arms which are remote from the step, and on a fourth axis disposed in fixed relation to the railway car and set back from the first axis with respect to the car wall.

As explained hereinafter, this arrangement permits of convenient construction of a rugged running-board, the movable step of which can be exactly adapted to precise positions of withdrawal and of service. In fact, each transverse arm of the step forms in conjunction with the two associated link-arms of each pair an articulated quadrilateral having unequal arms, the proportions of which can be chosen by design as a function of the desired positions of the step and according to available space contingencies permitted by the structure of the car to be equipped.

In a preferred embodiment of the invention, the first and the fourth pivotal axes of the link-arms are located on the side nearest the car floor with respect to the second and third pivotal axes in the withdrawn position of the step; the link-arms of the rear pair are substantially vertical in the withdrawn position of the step and substantially horizontal in the service position. Preferably, in the service position of the movable step, the third axis is located slightly above the plane defined by the second and fourth axes. The assembly formed by the movable step and by the two transverse arms is so designed that the center of gravity of said assembly is located opposite to the third axis with respect to the second axis in the service position in order to ensure stable upward displacement of the third axis to a position of application against a stop.

Said upward thrust of the third axis against a stop located above the plane defined by the second and fourth axes ensures natural immobilization of the movable step in the service position as a result of the abutting force which is applied by the articulation of the transverse arms and of the rear pair of link-arms and which prevents downward displacement of the third axis.

Preferably, means are provided for elastically urging the second axis towards the fourth axis. These elastic means complete the abutting action aforesaid in order to ensure immobilization of the step in the service position in all cases as will be explained hereinafter.

Preferably, the operating mechanism comprises a jack so arranged that the jack body is associated with a control circuit and mounted on the railway car along a horizontal axis of pivotal motion which is adjacent to the fourth pivotal axis of the link-arms. One end of an operating rod of the jack is pivotally mounted on the movable step between the first and the second pivotal axes of the link-arms in the service position of the step.

This arrangement makes it possible to ensure effective operation of the movable step as will be indicated hereinafter, especially for the immobilization of the step in the service position and subsequent withdrawal of said step.

Figure 2:
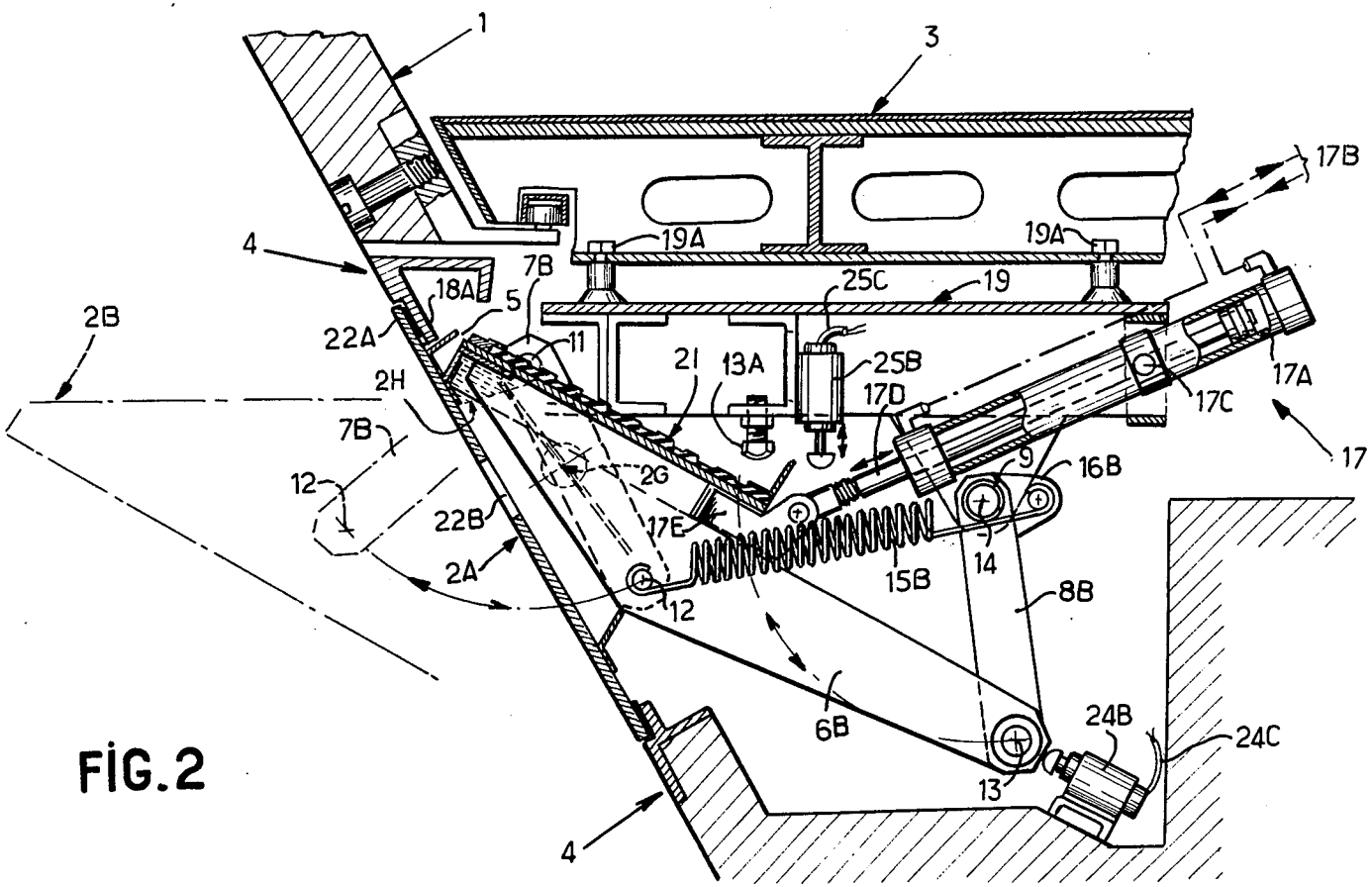
Figure 3:
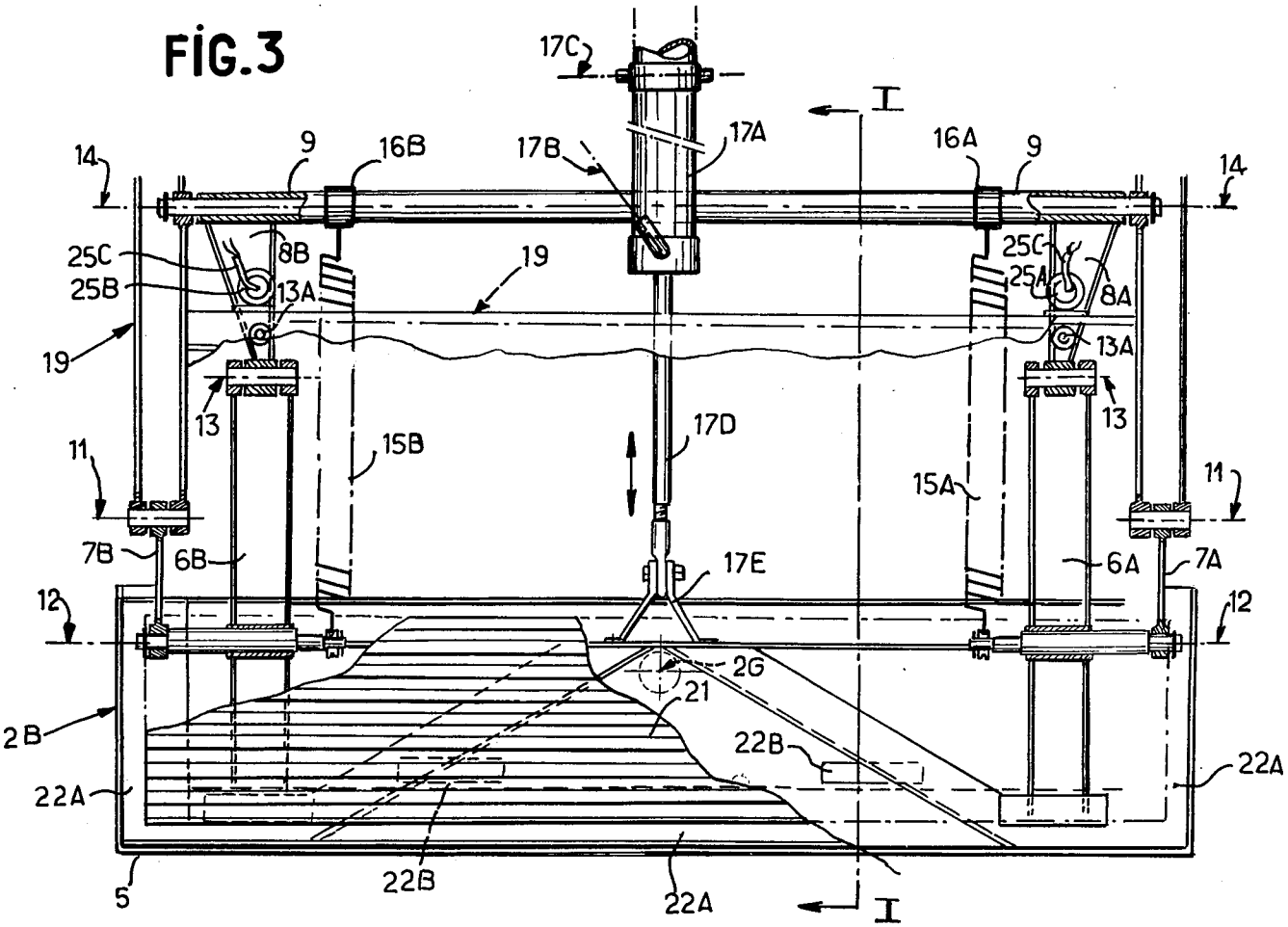
Figure 4:
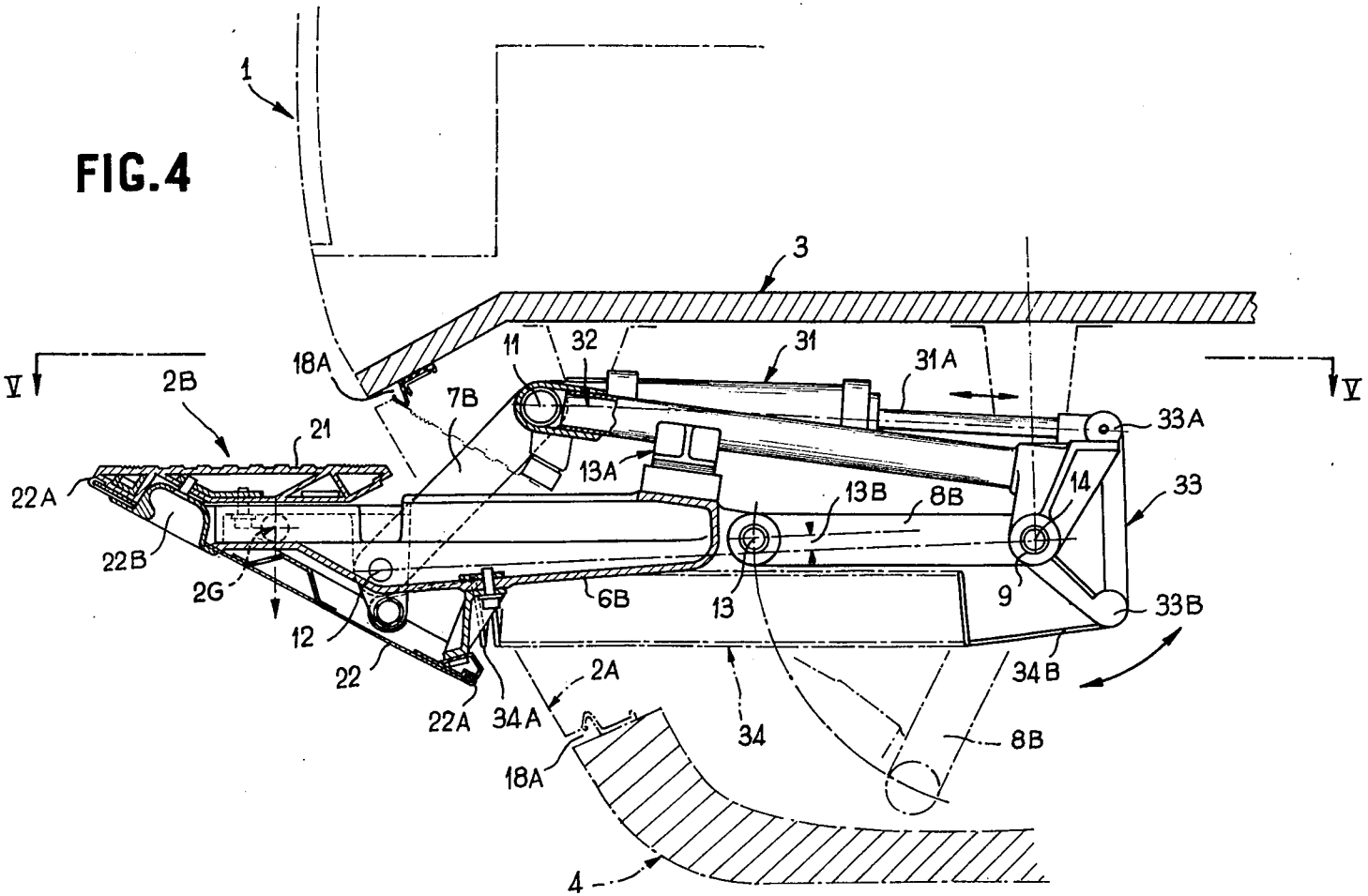
Figure 5:
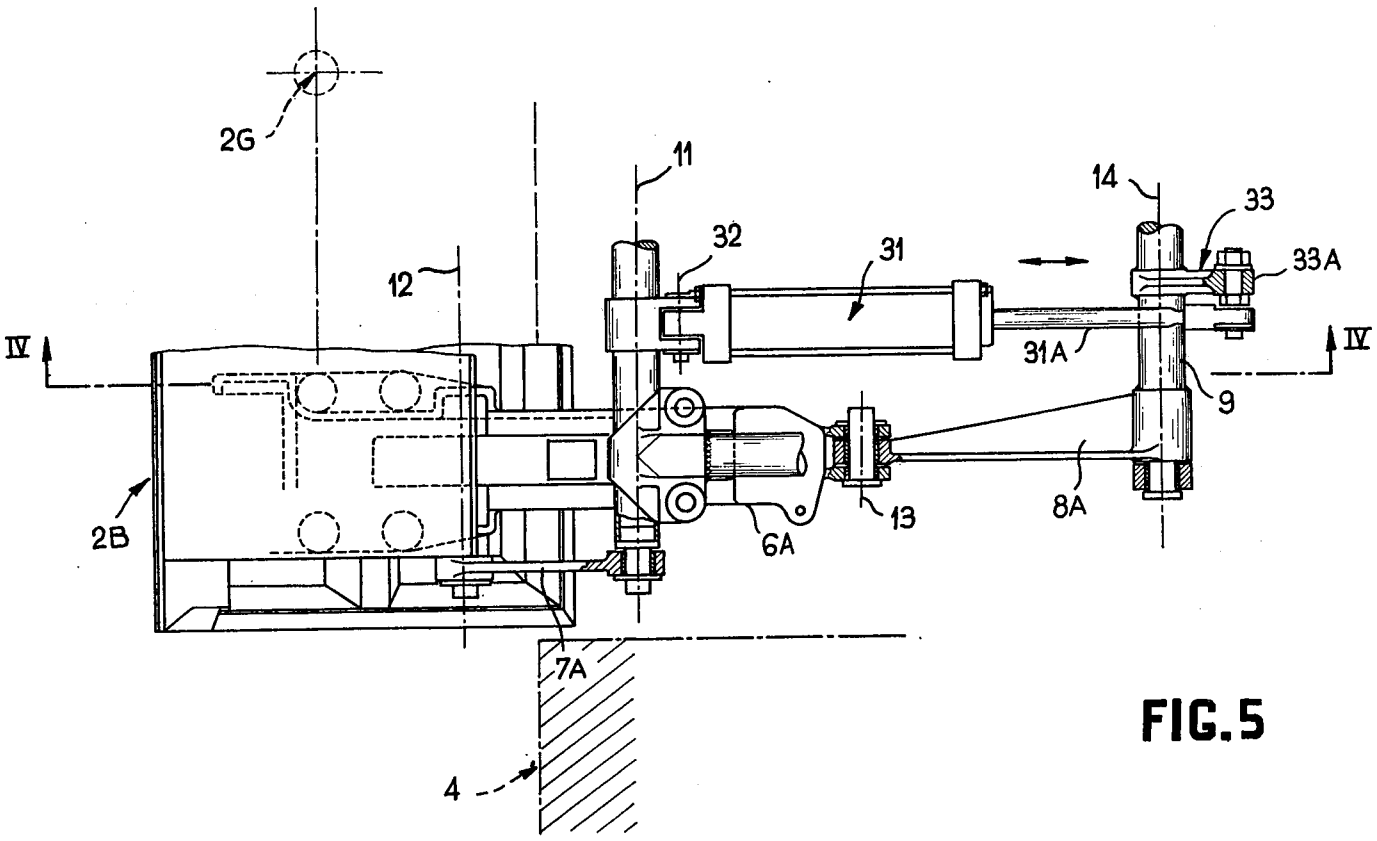

Further distinctive features and advantages of the invention will become apparent from the following description of a preferred embodiment which is presented below by way of example and not in any limiting sense, reference being made to the accompanying drawings, wherein:

FIG. 1 is a lateral sectional view of a running-board in accordance with the invention and in the service position of the movable step, this view being taken in section along line I—I of FIG. 3;

FIG. 2 corresponds to FIG. 1 in the withdrawn position of the movable step;

FIG. 3 is an overhead plan veiw taken along line III—III of the running-board of FIG. 1;

FIG. 4 which is similar to FIG. 1 illustrates an alternative embodiment of the running-board in accordance with the invention in the service position, this view being taken in section along line IV—IV of FIG. 5;

FIG. 5 which is similar to the right-hand portion of FIG. 3 is a partial overhead plan view of FIG. 4 and taken along line V—V.

In the embodiment shown in FIGS. 1 to 3, the retractable running-board is mounted beneath a railway car or coach door 1 such as, for example, an oblique-displacement sliding door. The running-board comprises a substantially rectangular movable step 2 associated with an operating mechanism which is mounted beneath the floor 3 of the railway car or coach. The operating mechanism which is described hereinafter serves to displace the step 2 between a withdrawn position 2A (FIG. 2) and a service position 2B (FIG. 1).

In the withdrawn position 2A, the movable step is applied against one wall 4 of the railway car, said wall being profiled and inclined, for example. In the service position 2B (FIG. 1), the step is swung outwards horizontally and has an outwardly projecting front edge 5 in order to ensure ease of access at the level of the car floor 3.

In accordance with the invention, the movable step 2 is rigidly extended on the side opposite to its front edge 5 by means of two transverse arms 6A, 6B of equal length which are substantially horizontal in the service position of the step. The operating mechanism comprises two pairs of link-arms 7A, 7B, 8A, 8B, the ends of which are pivotally mounted on four horizontal axes 11, 12, 13, 14 which are parallel to the front edge 5 of the step 2 (as shown in FIGS. 1, 2 and 3).

The two ends of each link-arm 7A, 7B of the first pair or so-called front pair are mounted respectively on a first axis 11 disposed in fixed relation to the car floor 3 and on a second axis 12 disposed in fixed relation to the step 2, in the vicinity of the point at which each transverse arm 6A, 6B is connected to said step.

The two ends of each link-arm 8A, 8B of the second pair or so-called rear pair are mounted respectively on a third axis 13 located in a fixed position at those ends of the transverse arms 6A, 6B which are remote from the step 2 and on a fourth axis 14 disposed in fixed relation to the car floor 3 and set back from the first axis 11 with respect to the wall 4 of the car.

In an advantageous manner, the ends of the two link-arms 8A, 8B of the second rear pair which are associated with the axis 14 are made fast for rotation with respect to said axis, for example by means of a coordinating tube 9. The two portions of the deformable systems 6, 7, 8 are thus maintained in parallel relation and smoothness of operation of the mechanism for operating the movable step 2 is accordingly ensured as will be explained hereinafter.

Preferably, as shown in FIG. 2, the first pivotal axis 11 and the fourth axis 14 are located on the side nearest the floor 3 of the car with respect to the second and third axes 12, 13. The link-arms 8A, 8B of the rear pair are substantially vertical in the withdrawn position 2A of the movable step (FIG. 2) and substantially horizontal in the service position 2B of the step (FIG. 1).

In the service position 2B of the step, the third pivotal axis 13 is preferably located slightly above the plane defined by the second and fourth axes 12, 14.

An adjustable stop 13A (shown in FIGS. 1, 2 and 3) permits accurate adjustment of the interval 13B of the axis 13 above the plane 12/14 in order to set in accordance with requirements the position of abutting application of the pivotal axis 13 of the transverse arms 6A, 6B and of the associated link-arms 8A, 8B. The interval 13B is of the order of 15 mm, for example. The stop 13A thus makes it possible to adjust the service position 2B of the step (FIG. 1) in order to ensure precise horizontal position-setting of this latter.

In the service position (FIG. 1), the assembly formed by the movable step 2B and by the two transverse arms 6A, 6B (FIG. 3), is so designed that the center of gravity 2G is located at a point remote from the third axis 13 with respect to the second axis 12. The couple resulting from the position of the center of gravity 2G just mentioned has the effect of upwardly displacing the third axis 13 in a stable manner and of maintaining applied against each stop 13A a portion of each rear link-arm 8B which is adjacent to the axis 13.

As a consequence of the foregoing, each shaft having an axis 13 on which the transverse arms 6A, 6B and the rear link-arms 8A, 8B are pivotally mounted is located in a position of abutting application so as to produce a buttressing action, thus ensuring stable immobilization of the movable step 2B in the service position (as shown in FIG. 1).

If necessary, the position of the center of gravity 2G and the value of the couple exerted on the axis 13 in the upward direction can be adjusted by means of a removable weight block (shown diagrammatically at 2H in FIG. 1) which is placed in the front portion of the step 2P. The above-mentioned adjustment of the position of the center of gravity 2G and of the value of the corresponding stabilization couple is advantageously achieved by dimensioning the front portion of the step 2B in accordance with requirements and in such a manner as to ensure high strength of the step.

Preferably, means are provided in addition for elastically displacing the second axis 12 towards the fourth axis 14 in order to complete the buttressing action aforesaid, especially with a view to ensuring safety of the step 2B in the service position in spite of any jerks which may occur.

As shown in FIGS. 1 to 3, the elastic means aforesaid comprise for example in the vicinity of each transverse arm 6A, 6B two restoring springs 15A, 15B which act in tension.

One end of each spring 15 is connected to the step 2 in proximity to the second pivotal axis 12 of the link-arms. The other end of each spring 15 is attached to one end of a lever 16A, 16B which is mounted transversely on the coordinating tube 9 and transversely with respect to each link-arm 8A, 8B of the rear pair. Thus the spring 15 in the service position 2B of the movable step (FIGS. 1 and 3) urges in the upward direction the end of the link-arm 8 which is associated with the third axis 13 while drawing the second axis 12 towards the stationary axis 14.

The operating mechanism comprises a jack 17, the body 17A of which is associated with a control circuit 17B of the pneumatic type, for example, said circuit being shown diagrammatically in FIGS. 1 and 2. The jack body 17A is mounted beneath the floor 3 of the railway car on a horizontal axis of pivotal motion 17C which is adjacent to the fourth pivotal axis 14 of the link-arms. One end of the operating rod 17D of the jack 17 is pivotally mounted on a coupling bracket 17E which is attached to the rear portion of the movable step 2 between the first pivotal axis 11 of the link-arms 7A, 7B and the second axis 12 in the service position of the step 2 (FIG. 1).

As shown in FIGS. 1 to 3, the complete operating mechanism of the movable step 2 is placed beneath the floor 3 of the car, the wall 4 of which is provided with an opening 18 for the passage of the step 2 as well as the transverse arms 6A, 6B of this latter and of the first pair of link-arms 7A, 7B in the service position 2B of the step (FIG. 1).

The step 2 has a structure of sufficient thickness in order to ensure the requisite strength in the service position 2B of the step. A tread surface 21 provided for example with a non-slip coating is fixed on the top face of said structure whilst a bearing surface 22 is fixed underneath this latter. An edge 22A is provided on said bearing surface and adapted to be applied against an edge 18A of the opening 18 of the wall 4 in the withdrawn position of the step 2. The bearing face 22 is then located substantially in the line of extension of the car wall 4, a continuous and uninterrupted profile of said wall being thus maintained.

The bearing face 22 of the step 2 is provided with two recesses 22B each forming a handle for operating the step by hand from the exterior as will be explained below.

The complete mechanism for operating the step 2 is advantageously carried by an auxiliary structure 19 which is removably fixed beneath the floor 3 of the car. Attachment of the auxiliary structure 19 is achieved for example by means of bolts 19A which are disposed in a standardized manner in order to permit of interchangeable assembly of the running-board.

The operation of the running-board in accordance with the invention and as described with reference to FIGS. 1 to 3 will now be explained.

When the movable step 2 is located for example in the withdrawn position 2A (as shown in FIG. 2) and if action is produced on the control circuit 17B in order to displace the operating rod 17D, the step 2 is accordingly displaced outwards through the opening 18 of the wall 4.

The movable shafts having pivotal axes 12, 13 of the link-arms 7, 8 each describe a circular path which is centered respectively on the stationary axes 11, 14. These circular paths are represented by chain-dotted lines in FIGS. 1 and 2. The deformable system constituted by the link-arms 7, 8 and the transverse arms 6 is outwardly unfolded until it reaches a substantially horizontal position of the rear link-arms 8A, 8B (as shown in FIG. 1). In consequence, the action of the operating rod 17D of the jack has permitted an increase in tension of the springs 15 in accordance with the extension defined substantially by the distance between the axes 12 and 14.

The action of the transverse levers 16A, 16B facilitates pivotal motion of the rear link-arms 8A, 8B in the appropriate direction. Pivotal motion of the two levers 16 and of the two link-arms 8 is coordinated by means of the tube 9 (as shown in FIGS. 1 to 3), thus ensuring accurate parallel relation of the two portions of the deformable system 6, 7, 8. Thus the movable axes 12, 13 and the front edge 5 of the movable step 2 remain parallel to the stationary axes 11, 14 throughout the range of travel of the step between its end positions 2A, 2B. Smooth and jerk-free operation of the mechanism for actuating the movable step 2 is thus ensured.

When the movable axis 13 comes substantially into alignment with the other two axes 12, 14, the couple exerted by the levers 16 on the rear link-arms 8 as a result of the tension of the springs 15 ensures that the articulation associated with the axis 13 is applied against the adjustable stop 13A. The couple exerted on the bracket 17E as a result of the thrust exerted by the end of the operating rod 17D of the jack also facilitates pivotal motion of the transverse arms 6A, 6B about the axis 12 in order to perform the above-mentioned operation which consists in applying the articulation having an axis 13 against the stop 13A.

In the service position 2B (FIG. 1), the movable step is thus immobilized in a stable manner as a result of abutting application of the transverse arms 6A, 6B and of the rear link-arms 8A, 8B, the pivotal axis 13 of which has passed beyond the plane 12/14 through the interval 13B which is adjusted according to requirements to a value of 15 mm, for example, by means of the adjustable stop 13A.

By virtue of the device provided by the invention, locking of the movable step in the service position 2B is ensured in a stable and reliable manner, even in the event of a pressure drop within the control circuit 17B. In fact, the tension of the two restoring springs 15A, 15B draws the movable axis 12 towards the stationary axis 14 and also has the effect of producing upward pivotal displacement of the rear link-arms 8A, 8B by means of the transverse levers 16A, 16B. The coordinating tube 9 of the two levers 16 and of the two link-arms 8 ensures that the step is locked in the service position 2B even in the event of failure of one of the two restoring springs 15A, 15B.

Even in the event of failure of the pneumatic jack 17 and of the restoring springs 15A, 15B, the position of the center of gravity 2G (FIG. 1) always ensures safety of the step 2B in the service position by virtue of the couple thus exerted in the upward direction by the weight of the step 2B on each articulation 13 so as to maintain each articulation applied against the associated stop 13A.

In order to return the movable step to the withdrawn position 2A from the service position 2B of FIG. 1, action is produced on the control circuit 17B of the jack 17 in the appropriate direction so as to initiate withdrawal of the operating rod 17D of the jack. The tractive force applied by the rod 17D on the coupling bracket 17E of the step exerts on the transverse arms 6A, 6B with respect to the axis 12 a couple which initiates downward displacement of the articulation having an axis 13. The buttressing action of the arms 6 and 8 is accordingly suppressed and the action of the restoring springs 15A, 15B can be added to that of the operating rod 17D in order to bring the movable axis 12 towards the axis 14 until the withdrawn position 2A of the step is reached, as shown in FIG. 2. In this withdrawn position, the edge 22A of the bearing face 22 of the step is applied against the corresponding edge 18A of the opening 18 formed in the wall 4.

The movable step is maintained in the withdrawn position 2A (as shown in FIG. 2), even in the event of a pressure drop within the control circuit 17B, by means of the residual tension of the two restoring springs 15A, 15B. The design is such that this tension has the effect of drawing the movable axis 12 towards the stationary axis 14 in the aforesaid withdrawn position of the step. The coordinating tube 9 of the two transverse levers 16A, 16B and of the two rear link-arms 8A, 8B ensures that the movable step is maintained in the withdrawn position 2A as mentioned above even in the event of failure of one of the two springs 15A, 15B.

As has already been noted, the running-board in accordance with the invention offers a number of important advantages over running-boards of known types.

By suitably choosing the proportions of the articulated-quadrilateral elements formed by the four pivotal axes 11, 12, 13, 14 and by the movable members 6, 7, 8, it is possible to adapt the movable step 2 to precise withdrawal and service positions 2A, 2B and also to take into account the available space requirements governing the assembly of the running-board beneath the floor 3 of the railway car.

The system which is constructed in the manner just described is of relatively simple design and operates with a single jack 17. The coordinating tube 9 which provides a connection between the rear link-arms 8 and their transverse levers 16 ensures a parallel relationship between the two portions of the deformable system 6, 7, 8 as well as a parallel relationship between the movable axes 12, 13 and of the front edge 5 of the step 2 with respect to the stationary axes 11, 14. In consequence, the mechanism which serves to actuate the movable step 2 is permitted to operate both smoothly and without jerks. Since there is no potential danger of jamming, a jack 17 of moderate power and small overall size can be employed economically.

Locking of the substantially horizontal movable step in the service position 2B (as shown in FIG. 1) is ensured in a stable and reliable manner by the buttressing action of the transverse arms 6 of the step and of the rear link-arms 8, this being achieved by applying the articulation having an axis 13 against the stop 13A beyond the plane 12/14. Any effort exerted downwards on the tread face 21 of the movable step in the service position 2B increases the effect of application of the articulation having an axis 13 against the stop 13A without any attendant danger of withdrawal of the step.

The above-mentioned locking of the step 2B in the service position (FIG. 1) is ensured in a stable manner even in the event of a pressure drop within the control circuit 17B or in the event of failure of one of the restoring springs 15A, 15B. In fact, the tension of the other spring 15 draws the axis 12 towards the stationary axis 14 by upwardly displacing the rear link-arms 8 which are subjected by the coordinating tube 9 to the couple exerted by at least one of the transverse levers 16.

Even in the event of accidental and simultaneous failure of the control jack 17 and of the two restoring springs 15A, 15B, safety of the step 2B in the service position (FIG. 1) is still ensured by the position of the center of gravity 2G and by the couple thus exerted upwards on each articulation 13 which is maintained applied against the associated stop 13A.

Releasing of the movable step 2 with a view to returning this latter from its service position 2B (FIG. 1) to its withdrawn position 2A (FIG. 2) is carried out in a convenient manner by mounting between the axes 11 and 12 the end of the operating rod 17D which produces action on the rear coupling bracket 17E of the step 2. In fact, the couple thus exerted on the transverse arms 6 with respect to the axis 12 causes downward displacement of the articulation having an axis 13, thereby suppressing the buttressing action of the transverse arms 6 of the step which is associated with the rear link-arms 8. Adjustment of the buttressing interval 13B by means of the stop 13A permits of accurate adjustment of the articulated mechanism in order to facilitate this movement of withdrawal of the step 2.

Application of the edge 22A of the bottom face 22 of the step against the edge 18A of the opening 18 ensures continuity of profile of the car wall 4, thus meeting the requirements laid down in the case of a railway car of high-speed design.

Maintenance of the movable step in the withdrawn position 2A is ensured in the event of a pressure drop within the control circuit 17B by the residual tension of the restoring springs 15A, 15B which draw the axis 12 of the front link-arms 7A, 7B towards the stationary axis 14. The springs 15 are so designed as to have characteristics which guarantee this position-maintenance even in the event of failure of one of the springs 15, this being achieved by the action of the coordinating tube 9 which provides a connection between the rear link-arms 8 and the transverse levers 16.

In the event of lack of pressure within the control circuit 17B, the movable step 2 can readily be operated by hand from the exterior by means of the handles constituted by the recesses 22B. Starting from the withdrawn position 2B of the step (shown in FIG. 2), it is possible by means of said recess handles to exert a powerful action in opposition to the restoring springs 15 and thus to pull the step outwards until the rear link-arms 8 and the transverse arms 6 are in aligned relation (as shown in FIG. 1). The inertia of the step 2 and the tension of the springs 15 which produce action on the right-angled levers 16 cause upward displacement of the articulation having an axis 13 beyond the plane of the axes 12, 14. This permits application of the articulation aforesaid against the stop 13A and stable immobilization of the step in the service position 2B.

Conversely, by producing upward action on the bottom face 22 of the step in the service position 2B (FIG. 1), the articulation which has an axis 13 is displaced downwards below the plane 12/14. This permits withdrawal of the step under the action of the restoring springs 15 which draw the axis 12 towards the stationary axis 14.

As can readily be understood, the invention is not limited to the embodiment described in the foregoing by way of example and many alternative forms can accordingly be contemplated without thereby departing either from the scope or the spirit of the invention.

For example, the running-board can advantageously be equipped with two switching devices 24A, 24B for controlling the position of withdrawal 2A of the movable step (FIG. 2) and with two further switching devices 25A, 25B for controlling the service position 2B of the step (FIG. 1). As illustrated in the drawings, these switching devices can be associated with each of the two articulations having an axis 13, thereby permitting the possibility of detecting any deformation or irregularity of operation of the articulated running-board mechanism.

The position switches 24, 25 can be connected to visual signal circuits 24C, 25C which permit remote control of the movable step 2. The operation of the step can thus be made automatic, for example in order to be combined with the operation of the door 1. It is thus possible to permit opening of the door 1 only when the step is in the service position 2B (FIG. 1) and to prevent withdrawal of the step as long as the door 1 is not closed.

In order to combine the operation of the step 2 with the operation of the door 1 automatically in the manner which has just been mentioned, it is possible in accordance with known practice to employ an electromagnetic or electronic control device (not shown) for associating the control and visual display circuits 17B, 24C, 25C of the running-board with each other and with the control circuits (not shown) of the door 1.

Preferably, the door 1 can be actuated only by means of a visible operating member which requires an intentional movement such as, for example, a movable handle (not shown) associated with a door-locking mechanism. This precaution prevents untimely operation of the door which would be liable to cause accidents.

The alternative embodiment of the running-board in accordance with the invention as shown in FIGS. 4 and 5 has been developed from the foregoing. The operating jack 31 comprises a pivotal axis 32 (FIG. 5) which is adjacent to the first axis 11 of the two front link-arms 7. The end of the operating rod 31A of the jack 31 is pivotally mounted on one end 33A of a transverse lever 33 which is rigidly mounted on the coordinating tube 9 of the two rear link-arms 8.

Preferably (as shown in FIG. 4), the running-board is provided in this case with a single restoring spring 34 which acts in tension and one end 34A of which is attached to the movable step 2 in the vicinity of the second pivotal axis 12 of the two front link-arms 7. The other end 34B of the spring 34 is attached to one end 33B of an extension of the transverse lever 33 which is mounted on the coordinating tube 9 of the rear link-arms 8. The end 33B of the extension of the transverse lever 33 is located on the side opposite to the end of the operating rod 31A of the jack 31 with respect to the coordinating tube 9.

This alternative embodiment facilitates the large-scale industrial manufacture and assembly of the running-board in accordance with the invention.

We claim:

1. A retractable running-board especially for the door of a railroad car, and comprising a substantially rectangular movable step connected to the car floor by means of an articulated quadrilateral linkage comprising two pairs of link-arms connecting said floor to two transverse arms forming part of said movable step, said quadrilateral linkage being deformable in such a manner that, in respective positions of service position and withdrawal position, it becomes respectively concave and convex, so as to provide an abutting force in service position resulting from its concave form, springs for locking said service position by maintaining said abutting force, said springs (15A, 15B) being connected by one end to the movable step and by the other end to a lever (16A, 16B) that swings about an axis coaxial with the connection points of the rear link-arms (8A, 8B) with said floor of the car, said levers being pivotally connected to said rear link-arms.

2. A running-board according to claim 1, wherein said levers (16A, 16B) and said rear link-arms (8A, 8B) are fixed on a common tube (9) rotatably mounted on a common axle (14).

3. A running-board according to claim 1, wherein a stop is provided for limiting the deformation of said quadrilateral linkage by counteracting said springs.

4. A running-board according to claim 3, wherein said stop is adjustable for defining said service position of the movable step.

5. A running-board according to claim 1, wherein an operating jack is provided, the body of which is connected to a control circuit and mounted under the floor of the car so as to rock around a rocking axis.

6. A running-board according to claim 5, wherein said rocking axis of said jack body is closed to said rocking axle (14) of said rear link-arms, an end of the jack rod being connected to the movable step between connecting axes of the front link-arms in the service position of said movable stem.

7. A running-board according to claim 4, wherein the rocking axis (32) of the jack body (31) is close to the axis of connection of said front link-arms to said floor of the car, an end of the rod (31A) of said jack being connected to an end (33A) of a transverse lever (33) rigidly mounted on said tube (9) connecting said two rear link-arms.

8. A running-board according to claim 1, wherein said at least one switching device is connected to control means of a door of the car and to said control circuit of the jacks to allow said door to be opened only when said movable step is in service position and to allow said movable step to be withdrawn only when said door is closed.

9. A running-board according to claim 1, wherein the bearing face of the step is provided with at least one recess constituting a handle for operating said step by hand from the exterior.

10. A running-board according to claim 1, wherein said running-board comprises at least one switching device for the withdrawn position of the movable step and one service position switch for automatic operation of the movable step and remote control of said step.

* * * * *